US005137773A

United States Patent [19]

Malhotra

[11] Patent Number: 5,137,773

[45] Date of Patent: Aug. 11, 1992

[54] TRANSPARENCIES

[75] Inventor: Shadi L. Malhotra, Mississauga, Canada

[73] Assignee: Xerox Corporation, Stamford, Conn.

[21] Appl. No.: 587,781

[22] Filed: Mar. 2, 1990

[51] Int. Cl.[5] ..... B41M 5/00

[52] U.S. Cl. ..... 428/215; 428/195; 428/419; 428/421; 428/473.5; 428/475.2; 428/476.3; 428/479.3; 428/481; 428/507; 428/508; 428/509; 428/510; 428/518; 428/520; 428/534; 428/536

[58] Field of Search ..... 428/195, 419, 480, 481, 428/483, 500, 508, 509, 523, 532, 534, 536, 421, 507, 510, 473.5, 479.3, 476.3, 475.2, 518, 520, 215

[56] References Cited

U.S. PATENT DOCUMENTS

| | | | |
|---|---|---|---|
| 4,547,405 | 10/1985 | Bedell et al. | 427/256 |
| 4,555,437 | 1/1985 | Tanck | 428/212 |
| 4,575,465 | 3/1986 | Viola | 427/261 |
| 4,578,285 | 3/1986 | Viola | 428/195 |
| 4,592,954 | 6/1986 | Malhotra | 428/335 |
| 4,770,934 | 9/1988 | Yamasaki et al. | 428/331 |
| 4,778,711 | 10/1988 | Hosomura et al. | 428/211 |
| 4,865,914 | 9/1989 | Malhotra | 428/331 |
| 4,946,741 | 8/1990 | Aono et al. | 428/336 |
| 5,006,407 | 4/1991 | Malhotra | 428/336 |

FOREIGN PATENT DOCUMENTS 0125113 11/1984 European Pat. Off. .

OTHER PUBLICATIONS

Patent Abstracts of Japan, vol. 8, No. 109, p. 275 (1546) May 5, 1984.

Patent Abstracts of Japan, vol. 12, No. 51, p. 667 (2898) Feb. 16, 1988.

World Patent Index, Week 8906, AN89-041585.

*Primary Examiner*—Pamela R. Schwartz

*Attorney, Agent, or Firm*—E. O. Palazzo

[57] ABSTRACT

A transparent substrate material for receiving or containing an image comprised of a supporting substrate and a coating composition comprised of a mixture of (a) non ionic celluloses or blends thereof; (b) ionic celluloses or blends thereof; (c) poly(alkylene oxide); and a noncellulosic component selected from the group consisting of (1) poly(imidazoline)quaternized; (2) poly(N,N-dialkyl-dialkylene piperidinium halide); (3) poly(acrylamido alkyl propane sulfonic acid); (4) poly-(ethylene imine) epihalohydrin; (5) poly(acrylamide); (6) acrylamide-acrylic acid copolymer; (7) poly(vinyl pyrrolidone); (8) poly(vinyl alcohol); (9) vinyl pyrrolidone-dialkyl aminomethylmethacrylate copolymer quaternized; (10) vinyl pyrrolidone-vinyl acetate copolymer; and mixtures thereof. The substrate may be coated on one, or both sides depending, for example, on its use.

41 Claims, No Drawings

TRANSPARENCIES

BACKGROUND OF THE INVENTION

This invention relates generally to transparencies which, for example, are suitable for various printing processes such as ink jet, dot matrix, electrographic and xerographic imaging systems. More specifically, the present invention is directed to transparencies with certain coatings thereover, which transparencies, that is for example transparent substrate materials for receiving or containing a toner image, possess compatibility with toner and ink compositions, and permit improved toner and ink flow in the imaged areas of the transparency thereby enabling images of high quality, that is for example images with optical densities of greater than 1.0 in several embodiments, excellent toner fix, about 100 percent in some instances, and no or minimized background deposits to be permanently formed thereon. Thus, in one embodiment of the present invention there are provided a multi-purpose, for use in ink jet, electrophotographic, especially xerographic, dot matrix printers and the like, transparencies, that is for example a transparency useful in xerographic apparatuses such as the Xerox 1025 TM, the Xerox 1075 TM, in dot matrix printers, such as Roland PR-1012 TM and in ink jet printers such as those commercially available from Hewlett Packard DeskJet TM, the Xerox Corporation 4020 TM, the Hewlett Packard PaintJet TM, and the like comprised of a supporting substrate, and a coating composition on both sides thereof in an embodiment comprised of a mixture of nonionic celluloses, ionic celluloses, or poly(alkylene oxide) with a non-cellulosic component selected from the group consisting of (1) poly(imidazoline) quaternized; (2) poly(N,N-dimethyl-3,5-dimethylene piperidinium halide, especially the chloride); (3) poly(2-acrylamido-2-methyl propane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethylaminomethylmethacrylate copolymer quaternized; (10) vinyl pyrrolidone-vinyl acetate copolymer and the like; and wherein the coating composition may have dispersed therein colloidal silica particles, and other similar components for the primary purpose of traction during the feeding process. Also, the present invention is directed to imaged transparencies comprised of a supporting substrate with a coating mixture as illustrated herein.

Many different types of transparencies are known, reference for example U.S. Pat. No. 3,535,112, which illustrates transparencies comprised of a supporting substrate, and polyamide overcoatings. Additionally, there are disclosed in U.S. Pat. No. 3,539,340 transparencies comprised of a supporting substrate and coatings thereover of vinylchloride copolymers. Also known are transparencies with overcoatings of styrene acrylate or methacrylate ester copolymers, reference U.S. Pat. No. 4,071,362; transparencies with blends of acrylic polymers and vinyl chloride/vinylacetate polymers, as illustrated in U.S. Pat. No. 4,085,245; and transparencies with coatings of hydrophilic colloids as recited in U.S. Pat. No. 4,259,422. Furthermore, there are illustrated in U.S. Pat. Nos. (1) 4,489,122 transparencies with elastomeric polymers overcoated with poly(vinylacetate), or terpolymers of methylmethacrylate, ethyl acrylate, and isobutylacrylate; and (2) 4,526,847 transparencies comprised of overcoating of nitrocellulose and a plasticizer.

The disclosures of each of the aforementioned patents are totally incorporated herein by reference.

In a patentability search report the following prior art U.S. patents were provided: U.S. Pat. No. 4,547,405, which discloses an ink jet recording sheet comprised of a transparent support with a layer thereover comprising from 5 to about 100 percent by weight of a block copolymer latex of poly(vinyl alcohol) with polyvinyl(-benzyl ammonium chloride) and from 0 to 95 percent by weight of a water soluble polymer such as poly(vinyl alcohol), poly(vinyl pyrrolidone) and copolymers thereof, reference the Abstract of the Disclosure, and also note the teachings, for example, in columns 2 and 3 of this patent; U.S. Pat. No. 4,055,437, which according to the Abstract of the Disclosure, discloses a transparent recording medium comprised of a conventional transparency base material coated with hydroxy ethyl cellulose and optionally containing one or more additional polymers compatible therewith, with examples of additional polymers being polyacrylimides, polyvinylpyrrolidones, see for example column 2, lines 1 to 21, and note in column 2, beginning at line 60, that as optional additives there may be included in the coating composition for purposes of promoting ease of manufacture, handling and usage, particulate silica or other inorganic pigments to enhance nonblocking and slip properties by acting as a friction reducting agent, see column 2, lines 65 and 66; U.S. Pat. No. 4,575,465 which according to the Abstract of the Disclosure is directed to an ink jet recording sheet comprising a transparent support carrying a layer comprising up to 50 percent by weight of vinyl pyrridines/vinyl benzyl quaternary salt copolymer and a hydrophilic polymer selected from gelatin, poly(vinyl alcohol), hydroxyl propyl cellulose, and mixtures thereof, see for example columns 2 and 3, especially column 2, line 60, to column 3, line 12, and also note column 3, line 21, to column 4, line 28; U.S. Pat. No. 4,770,934 directed to an ink jet recording medium which according to the Abstract of the Disclosure contains at least one ink receptive layer containing synthetic silica of fine particle form as the main pigment, and having a recording surface dried by pressing said surface against a heated mirror surface, and further having an ink receptive layer with an absorption capacity of at least 10 g/m$^2$, see also the disclosure in columns 3 through 7, and moreover note the working Examples; also see specifically, for example, column 3, line 58, to column 4, line 16; and U.S. Pat. No. 4,865,914, the disclosure of which is totally incorporated herein by reference, directed to a transparency comprised of a supporting substrate and thereover a blend comprised of poly(ethylene oxide) and carboxymethyl cellulose together with the components selected from the group consisting of hydroxypropyl cellulose, and the like, reference the Abstract of the Disclosure, and note specifically the disclosure beginning with column 3, and specifically column 3, line 40, moreover, see specifically column 4, lines 10 to 32.

Other prior art includes U.S. Pat. No. 3,488,189, which discloses fused toner images on an imaging surface wherein the toner particles contain a thermoplastic resin, the imaging surface carries a solid crystalline plasticizer having a lower melting point than the melting range of the thermoplastic resin, and wherein the resulting toner image is heat fused, reference the Abstract of the Disclosure; see also columns 3, 4, and 5, especially at line 71, to column 6; a similar teaching is present in U.S. Pat. Nos. 3,493,412 and 3,619,279, and more specifically the '279 patent mentions in the Abstract that the external surfaces of the toner receiving member is substantially free of a material plasticizable by a solid crystalline plasticizer, and typically a plasticizer, such as ethylene glycol dibenzoate, may be available on the surface of the paper; further see column 3, lines 22 to 32, of the '279 patent for the types of receiving surfaces that may be treated; and a selection of patents, namely U.S. Pat. Nos. 3,535,112; 3,539,340; 3,539,341; 3,833,293; 3,854,942; 4,234,644; 4,259,422; 4,419,004; 4,419,005 and 4,480,003 that pertain to the preparation of transparencies by electrostatographic imaging techniques according to the aforementioned report.

Also known are transparency sheet materials for use in a plain paper electrostatic copier comprising (a) a flexible, transparent, heat resistant, polymeric film base, (b) an image receiving layer present upon a first surface of the film base, and (c) a layer of electrically conductive prime coat interposed between the image receiving layer and the film base. This sheet material can be used in either powder-toned or liquid-toned plain paper copiers for making transparencies, reference U.S. Pat. No. 4,711,816, the disclosure of which is totally incorporated herein by reference.

Additionally known is a transparency to be imaged as a copy sheet in plain paper copiers which transparency contains a transparent sheet having a surface adapted to receive an image imprinted thereon in a suitable electrostatic imaging apparatus and an opaque coating forming an opaque border completely around the sheet, reference U.S. Pat. No. 4,637,974, the disclosure of which is totally incorporated herein by reference.

Moreover, known is the preparation of transparencies by electrostatic means, reference U.S. Pat. No. 4,370,379, the disclosure of which is totally incorporated herein by reference, wherein there is described the transferring of a toner image to a polyester film containing, for example, a substrate and a biaxially stretched poly(ethylene terephthalate) film, including Mylar. Furthermore, in U.S. Pat. No. 4,234,644, the disclosure of which is totally incorporated herein by reference, there is disclosed a composite lamination film for electrophoretically toned images deposited on a plastic dielectric receptor sheet comprising in combination an optically transparent flexible support layer, and an optically transparent flexible intermediate layer of a heat softenable film applied to one side of the support; and wherein the intermediate layer possesses adhesion to the support.

With further respect to the prior art, there are illustrated in U.S. Pat. No. 4,370,379, the disclosure of which is totally incorporated herein by reference, transparencies with, for example, a polyester (Mylar) substrate with a transparent plastic film substrate 2 and an undercoating layer 3 formed on at least one surface of the substrate 2, and a toner receiving layer 4 formed on the undercoated layer, reference column 2, line 44. As coatings for layer 3, there can be utilized the resins as illustrated in column 3, including quaternary ammonium salts, while for layer 4 there are selected thermoplastic resins having a glass transition temperature of from a minus 50° to 150° C., such as acrylic resins, including ethylacrylate, methylmethacrylate, and propyl methacrylate; and acrylic acid, methacrylic acid, maleic acid, and fumaric acid, reference column 4, lines 23 to 65. At line 61 of this patent, there is mentioned that thermoplastic resin binders other than acrylic resins can be selected, such as styrene resins, including polystyrene and styrene butadiene copolymers, vinyl chloride resins, vinylacetate resins, and solvent soluble linear polyester resins. A similar teaching is present in U.S. Pat. No. 4,480,003 wherein there is disclosed a transparency film comprised of a film base coated with an image receiving layer containing thermoplastic transparent polymethacrylate polymers, reference column 2, line 16, which films are useful in plain paper electrostatic copiers. Other suitable materials for the image receiving layer include polyesters, cellulosics, poly(vinyl acetate), and acrylonitrile-butadiene-styrene terpolymers, reference column 3, lines 45 to 53. Similar teachings are present in U.S. Pat. No. 4,599,293 wherein there is described a toner transfer film for picking up a toner image from a toner treated surface, and affixing the image, wherein the film contains a clear transparent base and a layer firmly adhered thereto, which is also clear and transparent, and is comprised of the specific components as detailed in column 2, line 16. Examples of suitable binders for the transparent film that are disclosed in this patent include polymeric or prepolymeric substances, such as styrene polymers, acrylic, and methacrylate ester polymers, styrene butadienes, isoprenes, and the like, reference column 4, lines 7 to 39. The coatings recited in the aforementioned patent contain primarily amorphous polymers which usually do not undergo the desired softening during the fusing of the xerographic imaging processes such as the color process utilized in the Xerox Corporation 1005 TM, and therefore these coatings do not usually aid in the flow of pigmented toners. This can result in images of low optical density which are not totally transparent.

Ink jet recording methods and ink jet transparencies thereof are known. There is disclosed in U.S. Pat. No. 4,446,174 an ink jet recording method for producing a recorded image on an image receiving sheet with aqueous inks, and wherein an ink jet is projected onto an image receiving sheet comprising a surface layer containing a pigment, which surface layer is capable of adsorbing a coloring component present in the aqueous ink. Also, there is disclosed in U.S. Pat. No. 4,371,582 an ink jet recording sheet containing a latex polymer, which can provide images having excellent water resistance properties and high image density by jetting them onto an aqueous ink containing a water soluble dye. Similarly, U.S. Pat. No. 4,547,405 describes an ink jet recording sheet comprising a transparent support with a layer comprising 5 to 100 percent by weight of a coalesced block copolymer latex of poly(vinyl alcohol) with polyvinyl(benzyl ammonium chloride), and 0 to 95 percent by weight of a water soluble polymer selected from the group consisting of poly(vinyl alcohol), poly(vinyl pyrrolidone), and copolymers thereof. In the '405 patent there is also disclosed an ink jet recording sheet comprising a layer which includes poly(vinyl pyrrolidone). A support is also disclosed in the '405 patent, which support may include polycarbonates, see column 4, line 62, for example. The disclosures of each of the aforementioned patents are totally incorporated herein by reference.

In U.S. Pat. No. 4,680,235 there is disclosed an ink jet recording material with image stabilizing agents, see column 4, lines 32 to 58, for example. Also, in column 4, line 57, for example, this patent discloses the use of a plasticizer in a surface recording layer. Further, in U.S. Pat. No. 4,701,837 there is disclosed a light transmissive medium having a crosslinked polymer ink receiving layer; and U.S. Pat. No. 4,775,594 describes an ink jet transparency with improved wetting properties.

Other coatings for ink jet transparencies include blends of carboxylated polymers with poly(alkylene glycol), reference U.S. Pat. No. 4,474,850; blends of poly(vinyl pyrrolidone) with matrix forming polymers such as gelatin; or poly(vinyl alcohol) swellable by water and insoluble at room temperature but soluble at elevated temperatures, reference U.S. Pat. No. 4,503,111; and blends of poly(ethylene oxide) with carboxymethyl cellulose as illustrated in U.S. Pat. No. 4,592,954, mentioned herein, the disclosure of each of the aforementioned patents being totally incorporated herein by reference.

Moreover, in U.S. Pat. No. 4,592,954, mentioned herein, the disclosure of which is totally incorporated herein by reference, there is illustrated a transparency for ink jet printing comprised of a supporting substrate and thereover a coating consisting essentially of a blend of carboxymethyl cellulose, and polyethylene oxides. Also, in this patent there is illustrated a transparency wherein the coating is comprised of a blend of hydroxypropylmethyl cellulose and poly(ethylene glycol monomethyl ether), a blend of carboxy methyl cellulose and poly(vinyl alcohol), or a blend of hydroxyethyl cellulose and vinyl pyrrolidone/diethylamino methylmethacrylate copolymer. One disadvantage associated with the transparencies of U.S. Pat. No. 4,592,954 is their insufficient resistance to relative humidities of, for example, exceeding 50 percent at 80° F. which leads to the onset of blooming and bleeding of colors in the printed text or graphics only in four to six hours. These and other disadvantages are avoided or minimized with the transparencies of the present invention.

In U.S. Pat. No. 4,865,914 the disclosure of which is totally incorporated herein by reference, there are illustrated ink jet transparencies comprised of a supporting substrate and thereover a blend comprised of poly(ethylene oxide) and carboxymethyl cellulose together with a component selected from the group consisting of (1) hydroxypropyl cellulose; (2) vinylmethyl ether/maleic acid copolymer; (3) carboxymethyl hydroxyethyl cellulose; (4) hydroxyethyl cellulose; (5) acrylamide-acrylic acid copolymer; (6) cellulose sulfate; (7) poly(2-acrylamido-2-methyl propane sulfonic acid); (8) poly(-vinyl alcohol); (9) poly(vinyl pyrrolidone); and (10) hydroxypropyl methyl cellulose. One of the disadvantages of the transparencies based on binary blends of carboxymethyl cellulose, with poly(ethylene oxide) cited in U.S. Pat. No. 4,592,954 and ternary blends of carboxymethyl cellulose, poly(ethylene oxide), hydroxypropyl cellulose or ternary blends of carboxymethylcellulose, poly(ethylene oxide), vinylmethylether/-maleic acid copolymer cited in U.S. Pat. No. 4,865,914 is the shift of the bluish-black color to reddish-black when printed with, for example, a Hewlett Packard DeskJet TM printer.

In U.S. Pat. No. 4,956,225, there are disclosed transparencies suitable for electrographic and xerographic imaging comprised of a polymeric substrate with a toner receptive coating on one surface thereof, which coating is comprised of blends of: poly(ethylene oxide) and carboxymethyl cellulose; poly(ethylene oxide), carboxymethyl cellulose and hydroxypropyl cellulose; poly(ethylene oxide) and vinylidene fluoride/hexafluoropropylene copolymer, poly(chloroprene) and poly(α-methylstyrene); poly(caprolactone) and poly(α-methylstyrene); poly(vinylisobutylether) and poly(α-methylstyrene); blends of poly(caprolactone) and poly(p-isopropyl α-methylstyrene); blends of poly(1,4-butylene adipate) and poly(α-methylstyrene); chlorinated poly(propylene) and poly(α-methylstyrene); chlorinated poly(ethylene) and poly(α-methylstyrene); and chlorinated rubber and poly(α-methylstyrene). Further, in another aspect of the U.S. Pat. No. 4,956,225, the disclosure of which is totally incorporated herein by reference, there are provided transparencies suitable for electrographic and xerographic imaging processes comprised of a supporting polymeric substrate with a toner receptive coating on one surface thereof comprised of: (a) a first layer coating of a crystalline polymer selected from the group consisting of poly(chloroprene), chlorinated rubbers, blends of poly(ethylene oxide), and vinylidene fluoride/hexafluoropropylene copolymers, chlorinated poly(propylene), chlorinated poly(ethylene), poly(vinylmethyl ketone), poly(caprolactone), poly(1,4-butylene adipate), poly(-vinylmethyl ether), and poly(vinyl isobutylether); and (b) a second overcoating layer comprised of a cellulose ether selected from the group consisting of hydroxypropyl methyl cellulose, hydroxypropyl cellulose, and ethyl cellulose.

In a U.S. Pat. No. 5,006,407, the disclosure of which is totally incorporated here by reference, there is disclosed a transparency comprised of a hydrophilic coating and a plasticizer, which plasticizer can, for example, be selected from the group consisting of phosphates, substituted phthalic anhydrides, glycerols, glycols, substituted glycerols, pyrrolidinones, alkylene carbonates, sulfolanes, and stearic acid derivatives.

In another U.S. Pat. No. 5,068,140, the disclosure of which is totally incorporated here by reference, there is disclosed a transparent substrate material for receiving or containing an image comprised of a supporting substrate, an anticurl coating layer or coatings thereunder, and an ink receiving layer thereover.

In U.S. Pat. No. 4,997,697, the disclosure of which is totally incorporated here by reference, there is disclosed a transparent substrate material for receiving or containing an image and comprised of a supporting substrate base, an antistatic polymer layer coated on one or both sides of the substrate and comprised of hydrophilic cellulosic components, and a toner receiving polymer layer contained on one or both sides of the antistatic layer, which polymer is comprised of hydrophobic cellulose ethers, hydrophobic cellulose esters or mixtures thereof, and wherein the toner receiving layer contains adhesive components.

In copending application U.S. Ser. No. 370,677, the disclosure of which is totally incorporated here by reference, there is disclosed an imaged transparency comprised of a supporting substrate, oil absorbing layer comprised of, for example, chlorinated rubber, styrene-olefin copolymers, alkylmethacrylate copolymers, ethylene-propylene copolymers, sodium carboxymethyl cellulose or sodium carboxymethylhydroxyethyl cellulose; an ink receiving polymer layers comprised of, for example, vinyl alcohol-vinyl acetate, vinyl alcohol-vinyl butyral or vinyl alcohol-vinyl acetate-vinyl chloride copolymers. The ink receiving layers may include therein or thereon fillers such as silica, calcium carbonate, or titanium dioxide.

In U.S. Pat. No. 5,075,153, the disclosure of which is totally incorporated herein by reference, there is disclosed a never-tear coated paper comprised of a plastic supporting substrate, a binder layer comprised of polymers selected from the group consisting of (1) hydroxypropyl cellulose, (2) poly(vinyl alkyl ether), (3) vinyl pyrrolidonevinyl acetate copolymer, (4) vinyl pyrrolidone-dialkylamino ethyl methacrylate copolymer quaternized, (5) poly(vinyl pyrrolidone), (6) poly(ethylene imine), and mixtures thereof; and a pigment or pigments; and an ink receiving polymer layer.

Although the transparencies illustrated in the prior art are suitable in most instances for their intended purposes, there remains a need for new transparencies with coatings thereover, which transparencies are useful in ink jet printing, dot matrix printing, electrophotographic and xerographic imaging processes, and that will enable the formation of images with high optical densities. Additionally, there is a need for all purpose transparencies which permit improved ink and toner flow in the imaged areas thereby enabling high quality transparent images with acceptable optical densities. There is also a need for all purpose transparencies that possess other advantages, inclusive of enabling excellent adhesion between the toned image and the transparency selected, and wherein images with excellent resolution and no background deposits are obtained. There is also a need for transparencies that can be used in more than one type of ink jet xerographic or electrophotographic apparatuses as is the situation with the transparencies of the present invention. Another need of the present invention resides in providing transparencies with coatings that do not (block) stick at, for example, high relative humidities of, for example, 50 to 80 percent and at a temperature of 50° C. in many embodiments.

SUMMARY OF THE INVENTION

It is an object of the present invention to provide transparencies with many of the advantages illustrated herein.

Another object of the present invention resides in the provision of transparencies with certain coatings, which transparencies are useful in various ink jet printers such as the Xerox Corporation 4020 TM, the Hewlett Packard DeskJet TM and Hewlett Packard PaintJet TM apparatuses.

Also, in another object of the present invention there are provided transparencies with certain coatings thereover enabling images thereon with high optical densities, and wherein increased toner flow is obtained when imaged, for example, with commercially available xerographic imaging apparatuses and ionographic printers, inclusive of printers commercially available from Delphax such as the Delphax S-6000.

Moreover, another object of the present invention resides in imaged transparencies that have substantial permanence for extended time periods.

Another object of the present invention resides in the provision of transparencies for xerographic or electrographic systems such as the Xerox Corporation 1005 TM imaging apparatus, the Xerox Corporation 1005 TM imaging apparatus, the Xerox Corporation 1025 TM imaging apparatus, or the Xerox Corporation 1075 TM imaging apparatus.

Additionally, in another object of the present invention there are provided all purpose transparencies with, for example, blends of coatings on a supporting substrate which are useful for dot matrix printers such as the Roland PR-1012 TM.

These and other objects of the present invention are accomplished by providing transparencies with coatings thereover. In accordance with one embodiment of the present invention, there are provided all purpose xerographic transparencies with coatings thereover which are compatible with the toner compositions selected for development, and wherein the coatings enable images thereon with acceptable optical densities to be obtained. More specifically, in one embodiment of the present invention there are provided transparencies for ink jet printing processes and xerographic printing processes, which transparencies are comprised of a supporting substrate and a coating composition thereon comprised of a mixture selected from the classes of materials comprised of (a) nonionic celluloses such as hydroxylpropylmethyl cellulose, hydroxyethyl cellulose, hydroxybutyl methyl cellulose, or mixtures thereof; (b) ionic celluloses such as anionic sodium carboxymethyl cellulose, anionic sodium carboxymethyl hydroxyethyl cellulose, cationic celluloses, or mixtures thereof; (c) poly(alkylene oxide) such as poly(ethylene oxide) together with a noncellulosic component selected from the group consisting of (1) poly(imidazoline) quaternized; (2) poly(N,N-dimethyl-3,5-dimethylene piperidinium chloride); (3) poly(2-acrylamido-2-methyl propane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethyl aminomethylmethacrylate copolymer quaternized; (10) vinyl pyrrolidonevinyl acetate copolymer; and mixtures thereof.

The aforementioned coating compositions are generally present on both sides of a supporting substrate, and in one embodiment the coating is comprised of nonionic hydroxyethyl cellulose, 25 percent by weight, anionic sodium carboxymethyl cellulose, 25 percent by weight, poly(ethylene oxide), 25 percent by weight, and poly(acrylamide), 25 percent by weight.

Also, the coating can contain colloidal silica particles, a carbonate, such as calcium carbonate, and the like primarily for the purpose of transparency traction during the feeding process. In one embodiment, the coating composition can thus be comprised of a mixture of nonionic hydroxyethyl cellulose, 25 percent by weight, nonionic hydroxypropyl methyl cellulose, 20 percent by weight, anionic sodium carboxymethyl cellulose, 20 percent by weight, poly(ethylene oxide), 20 percent by weight, acrylamide-acrylic acid copolymer, 12 percent by weight, and colloidal silica, 3 percent by weight.

In another embodiment of the present invention, there is provided, for example, a transparent substrate material for receiving or containing an image comprised of a supporting substrate and a coating composition comprised of a mixture of (a) nonionic celluloses and blends thereof; (b) ionic celluloses and blends thereof; (c) poly(alkylene oxide); and an additional noncellulosic component selected from the group consisting of (1) poly(imidazoline) quaternized; (2) poly(N,N-dimethyl-3,5-dimethylene piperidinium chloride); (3) poly(2-acrylamido-2-methyl propane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethyl aminomethylmethacrylate copolymer quaternized; (10) vinyl pyrrolidonevinyl acetate copolymer; and mixtures thereof.

In the aforementioned multicomponent coating compositions comprised of nonionic celluloses, ionic celluloses, poly(ethylene oxide), and other additional noncellulosic components, poly(ethylene oxide) is primarily responsible for enhancing color mixing; ionic celluloses are present for the primary purpose of retaining the crystal size of poly(ethylene oxide) between 60 to 200 Å and avoiding the formation of spherulites (aggregates of small crystals) which can grow to sizes greater than the wavelength of light and thus scatter light leaving the dried coating compositions opaque; nonionic celluloses are selected primarily for their excellent coating capability of the substrate base; the noncellulosic components such as quaternized poly(imidazoline), vinyl pyrrolidonediethylamino methylmethacrylate copolymer quaternized, poly(ethylene imine) epichlorohydrin, poly(N,N-dimethyl-3-5-dimethylene piperidinium chloride) enable dyes to bind to the coating, poly(vinyl alcohol), poly(vinyl pyrrolidone) and its derivatives assist in retaining additional moisture in the coating and poly(acrylamide) and its derivatives enable the imaged transparencies to dry rapidly.

In another embodiment, the present invention is directed to transparencies comprised of a supporting substrate, such as Mylar, with a thickness of from about 50 to about 150 microns with a coating composition on both sides thereof comprised in an effective thickness of from, for example, about 5 to about 25 microns of a mixture comprising from about 1 to about 60 percent by weight of the nonionic celluloses, from about 55 to about 1 percent by weight of ionic celluloses, from about 43 to about 1 percent by weight of poly(ethylene oxide) and from about 1 to about 38 percent by weight of the noncellulosic additional component. When these aforementioned coating compositions contain filler components, the coating mixture can be comprised of, for example, from about 1 to about 50 percent by weight of the nonionic celluloses, from about 55 to about 1 percent by weight of ionic celluloses, from about 42 to about 1 percent by weight of poly(ethylene oxide), from about 1 to about 23 percent by weight of the noncellulosic additional component and from about 1 to about 25 percent by weight of the filler.

Specifically, in one embodiment of the present invention there are provided imaged transparencies comprised of a supporting substrate, such as a polyester, with a coating composition on both sides thereof comprised in an effective thickness of from about 3 to about 10 microns of a mixture of multicomponents selected from about 5 to about 50 percent by weight of nonionic celluloses such as methyl cellulose, ethyl cellulose, ethylmethyl cellulose, hydroxyethyl cellulose, hydroxypropyl cellulose, dihydroxy propyl cellulose, hydroxyethyl hydroxypropyl cellulose, methylhydroxyethyl cellulose, ethylhydroxyethyl cellulose, hydroxymethylethyl cellulose, hydroxy ethylmethyl cellulose, hydroxy propylmethyl cellulose, hydroxybutylmethyl cellulose; from about 50 to about 5 percent by weight of ionic celluloses, such as anionic sodium carboxymethyl cellulose, anionic sodium carboxymethylethyl cellulose, anionic sodium carboxymethylhydroxyethyl cellulose, anionic sodium cellulose sulfate, cationic quaternary hydroxypropyl trimethyl ammonium chloride hydroxyethyl cellulose, cationic quaternary diethyl ammonium chloride cellulose, amphoteric carboxymethyl diaminoethyl cellulose; from about 40 to about 5 percent by weight of poly(ethylene oxide) and from about 4 to about 35 percent by weight of a non-cellulosic additional component selected from the group consisting of (1) poly(imidazoline) quaternized; (2) poly(N,N-dimethyl-3,5-dimethylene piperidinium chloride); (3) poly(2-acrylamido-2-methyl propane sulfonic acid); (4) poly(ethylene imine) epichlorohydrin; (5) poly(acrylamide); (6) acrylamideacrylic acid copolymer; (7) poly(vinyl pyrrolidone); (8) poly(vinyl alcohol); (9) vinyl pyrrolidone-diethyl aminomethyl methacrylate copolymer quaternized; and (10) vinyl pyrrolidone-vinyl acetate copolymer, which coating composition has dispersed therein colloidal silica particles in an amount of from about 1 to about 5 weight percent.

Illustrative examples of supporting substrates with an effective thickness of, for example, from about 50 microns to about 150 microns, and preferably of a thickness of from about 75 microns to about 125 microns that may be selected for the transparencies of the present invention include Mylar, commercially available from E. I. DuPont; Melinex, commercially available from Imperial Chemical Inc.; Celenar, commercially available from Celanese, Inc.; polycarbonates, especially Lexan; polysulfones, cellulose triacetate; poly(vinyl chlorides), cellophane and poly(vinyl fluorides); and the like, with Mylar being particularly preferred because of its availability and lower costs.

Illustrative examples of preferred coating compositions for the transparencies of the present invention in an embodiment include mixtures of (1) nonionic methyl cellulose (Methocel A4M, A15C available from Dow Chemical Company), ethyl cellulose (the reaction product of alkali cellulose with ethyl chloride with the degree of ethyl substitution being less than 1.7), ethylmethyl cellulose (the reaction product of ethylated methyl cellulose with the degree of ethyl substitution being less than 1.7), 35 percent by weight, anionic sodium carboxymethyl cellulose (CMC 7H3SX available from Hercules Chemical Company), sodium carboxymethyl hydroxyethyl cellulose (CMHEC 43H, 37L available from Hercules Chemical Company) or sodium cellulose sulfate (Scientific Polymer Products), 25 percent by weight, poly(ethylene oxide) (Poly OX WSRN-3000 available from Union Carbide) 20 percent by weight and poly(acrylamide) or vinylpyrrolidone-diethylamino-methylmethacrylate copolymer quaternized (both from Scientific Polymer Products), 20 percent by weight; (2) nonionic methyl cellulose (Methocel A4M), 40 percent by weight, cationic hydroxyethyl cellulose (Polymer JR-125 available from Union Carbide) or quaternary diethyl ammonium chloride cellulose (obtained by the reaction of 2-chloroethyldiamine hydrochloride with alkali cellulose and then quaternized), 20 percent by weight, poly(ethylene oxide) (Poly OX WSRN-3000), 20 percent by weight, and poly(imidazoline) quaternized (Scientific Polymer Products), 20 percent by weight; (3) nonionic methyl cellulose (Methocel A4M), 40 percent by weight, amphoteric carboxymethyl diaminoethyl cellulose (obtained by the reaction of 2-chloroethyldiamine hydrochloride with sodium carboxymethyl cellulose), 20 percent by weight, poly(ethylene oxide) (Poly OX WSRN-3000), 20 percent by weight, and poly(N,N-dimethyl-3,5-dimethylene piperidinium chloride) (Scientific Polymer Products), 20 percent by weight; (4) nonionic hydroxyethyl cellulose (Natrosol 250 LR available from Hercules Chemical Company), 25 percent by weight, anionic sodium carboxymethyl cellulose (CMC 7H3SX), sodium carboxy methylhydroxyethyl cellulose (CMHEC 37L available from Hercules Chemical Company) or sodium cellulose sulfate (Scientific Polymer Products), 25 percent by weight, poly(ethylene oxide) (Poly OX-WSRN-3000), 25 percent by weight, poly(acrylamide) (Scientific Polymer Products) or vinyl pyrrolidone-diethylamino methylmethacrylate copolymer quaternized (Scientific Polymer Products) or poly(ethylene imine) epichlorohydrin (Scientific Polymer Products), 25 percent by weight; (5) nonionic hydroxy ethyl cellulose (Natrosol 250 LR, Hercules Chemical Company), 35 percent by weight, cationic hydroxyethyl cellulose (Polymer JR-125 available from Union Carbide) or quaternary diethyl ammonium chloride cellulose, 25 percent by weight, poly(ethylene oxide) (Poly OX WSRN-3000), 20 percent by weight, poly(vinyl pyrrolidone) (GAF Corporation) or vinyl pyrrolidone-vinyl acetate copolymer with vinyl acetate content of from about 20 to about 60 percent by weight (Scientific Polymer Products), 20 percent by weight; (6) nonionic hydroxyethyl cellulose (Natrosol 250 LR), 40 percent by weight, amphoteric carboxymethyl diaminoethyl cellulose, 20 percent by weight, poly(ethylene oxide) (Poly OX WSRN-3000), 20 percent by weight, and poly(N,N-dimethyl-3,5-dimethylene piperidinium chloride) (Scientific Polymer Products), 20 percent by weight; (7) nonionic ethylhydroxyethyl cellulose (EHEC Bermocoll available from Berol Kem AB, Sweden) or methylhydroxyethyl cellulose (obtained by methylation of hydroxyethyl cellulose), 30 percent by weight, anionic sodium carboxymethyl cellulose (CMC 7H3SX), 30 percent by weight, poly(ethylene oxide) (Poly OX WSRN-3000), 30 percent by weight and vinyl pyrrolidone-diethylamino methylmethacrylate copolymer quaternized or poly(imidazoline) quaternized (both from Scientific Polymer Products) or poly(vinyl alcohol) (Elvanol available from DuPont Company) or vinyl pyrrolidone-vinyl acetate copolymer (Scientific Polymer Products), 10 percent by weight; (8) nonionic ethylhydroxyethyl cellulose (EHEC Bermocoll available from Berol KEM AB Sweden), 35 percent by weight, cationic hydroxyethyl cellulose (Polymer JR-125 available from Union Carbide) or quaternary diethylamino ethyl cellulose, 25 percent by weight, poly(ethylene oxide) (Poly OX WSRN-3000), 20 percent by weight, and poly(ethylene imine) epichlorohydrin (Scientific Polymer Products) or poly(2-acrylamido-2-methyl propane sulfonic acid) (Scientific Polymer Products), 20 percent by weight; (9) nonionic hydroxymethylethyl cellulose (obtained by hydroxymethylation of methyl cellulose) or hydroxyethylmethyl cellulose (HEM available from British Cellanese Ltd., Tylose MH, MHK available from Kalle A.G.) or hydroxypropylmethyl cellulose (Methocal K35LV available from Dow Chemical Company) or hydroxybutylmethyl cellulose (HBMC Methocel, Dow Chemical Company), 30 percent by weight, cationic hydroxyethyl cellulose (Polymer JR-125 available from Union Carbide), 20 percent by weight, poly(ethylene oxide) (Poly OX WSRN-3000), 35 percent by weight, poly(2-acrylamido-2-methyl propane sulfonic acid) or acrylamide-acrylic acid copolymer (both from Scientific Polymer Products), 15 percent by weight; (10) nonionic hydroxypropylmethyl cellulose (Methocel K35LV) or hydroxybutylmethyl cellulose (HBMC Methocel), 30 percent by weight, amphoteric carboxymethyl diaminoethyl cellulose, 30 percent by weight, poly(ethylene oxide) (Poly OX WSRN-3000), 30 percent by weight, and poly(vinyl alcohol) (Elvanol available from DuPont Company) or acrylamide-acrylic acid copolymer (Scientific Polymer Products), 10 percent by weight; (11) nonionic hydroxypropylmethyl cellulose (Methocel K35LV), 30 percent by weight, anionic sodium carboxymethyl cellulose (CMC 7H3SX) or sodium carboxy methylhydroxyethyl cellulose (CMHEC 37L) or sodium cellulose sulfate (Scientific Polymer Products), 30 percent by weight, poly(ethylene oxide) (Poly OX WSRN-3000), 20 percent by weight, and poly(acrylamide) (Scientific Polymer Products), 20 percent by weight; (12) nonionic hydroxyethyl cellulose (Natrosol 250 LR), 25 percent by weight, nonionic hydroxypropylmethyl cellulose (Methocel K35LV), 20 percent by weight, anionic sodium carboxymethyl cellulose (CMC 7H3SX), 20 percent by weight, poly(ethylene oxide) (Poly OX WSRN-3000), 20 percent by weight, acrylamide-acrylic acid copolymer (Scientific Polymer Products), 12 percent by weight, and colloidal silica (Syloid 74 available from Grace Company), 3 percent by weight.

Filler components in various effective amounts such as, for example, from about 1 to about 25 and preferably from about 1 to about 5 weight percent can be included in the coating as indicated herein. Examples of fillers include colloidal silicas preferably present, for example, in one embodiment in an amount of 1 weight percent (available as Syloid 74 from W. R. Grace Company); calcium carbonate (Microwhite Sylacauga Calcium Products), titanium dioxide (Rutile NL Chem. Canada Inc.), and the like. While it is not desired to be limited by theory, it is believed that the primary purpose of the fillers is as a slip component for the transparency traction during the feeding process.

The aforementioned coatings can be present on the supporting substrates, such as Mylar, in various thicknesses depending on the coatings selected and the other components utilized; however, generally the total thickness of the coatings is from about 2 to about 25 microns, and preferably from about 3 to about 10 microns. Moreover, these coatings can be applied by a number of known techniques including reverse roll, extrusion and dip coating processes. In dip coating, a web of material to be coated is transported below the surface of the coating material by a single roll in such a manner that the exposed site is saturated, followed by the removal of any excess by a blade, bar or squeeze rolls. With reverse roll coating, the premetered material is transferred from a steel applicator roll to the web material moving in the opposite direction on a backing roll. Metering is performed in the gap precision-ground stainless steel rolls. The metering roll is stationary or is coating slowly in the opposite direction of the applicator roll. Also, in slot extrusion coating there is selected a slot die to apply coating materials with the die lips in close proximity to the web of material to be coated. Once the desired amount of coating has been applied to the web, the coating is dried at 70° to 100° C. in an air dryer.

In one specific process embodiment, the xerographic and ink jet transparencies of the present invention are prepared by providing a supporting substrate such as Mylar in a thickness of from about 75 to about 125 microns; and applying to each side of the substrate by known dip coating process, in a thickness of from about 2 to 10 microns, a coating composition comprised of a mixture of multicomponents selected from the classes of materials comprised of (a) nonionic celluloses such as hydroxypropyl methyl cellulose, hydroxyethyl cellulose or hydroxybutyl methyl cellulose; (b) ionic celluloses such as anionic sodium carboxymethyl cellulose, anionic sodium carboxymethyl hydroxyethyl cellulose, cationic celluloses; (c) poly(alkylene oxide) such as poly(ethylene oxide); and (d) together with an additional noncellulosic component selected from the group consisting of (1) poly(imidazoline) quaternized; (2) poly(N,N-dimethyl-3,5-dimethylene piperidinium chloride); (3) poly(2-acrylamido-2-methylpropane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethyl aminomethylmethacrylate copolymer quaternized; or (10) a vinyl pyrrolidone-vinyl acetate copolymer. Thereafter, the substrate and coating are air dried at 25° C. for 60 minutes in a fume hood equipped with adjustable volume exhaust system. The resulting transparency can be utilized in various imaging apparatuses including the xerographic imaging apparatus such as those available commercially as the Xerox Corporation 1005 TM and wherein there results images thereon, ink jet apparatuses, such as Xerox Corporation 4020 TM, and the like.

The imaging technique in known ink jet printing involves, for example, the use of one or more ink jet assemblies connected to a pressurized source of ink, which is comprised of water, glycols, and a colorant such as magenta, cyan, yellow or black dyes. Each individual ink jet includes a very small orifice usually of a diameter of 0.0024 inch, which is energized by magneto restrictive piezoelectric means for the purpose of emitting a continuous stream of uniform droplets of ink at a rate of 33 to 75 kilohertz. This stream of droplets is desirably directed onto the surface of a moving web of, for example, the transparencies of the present invention, which stream is controlled to permit the formation of printed characters in response to video signals derived from an electronic character generator and in response to an electrostatic deflection system.

In the known formation and development of xerographic images, there is generally applied to a latent image generated on a photoconductive member a toner composition (dry or liquid) of resin particles and pigment particles. Thereafter, the image can be transferred to a suitable substrate such as natural cellulose, the transparencies of the present invention, or plastic paper and affixed thereto by, for example, heat, pressure or combination thereof.

In dot matrix printing, a printer such as Roland PR-1012 TM is connected to an IBM-PC computer loaded with a screen/printer software specially supplied for the printer. Any graphic images produced by the appropriate software on the screen can be printed by using the print screen key on the computer keyboard. The ink ribbons used in dot matrix printers are generally comprised of Mylar coated with blends of carbon black with reflex blue pigment dispersed in an oil, such as rape seed oil, and a surfactant, such as lecithin. Other correctable ribbons which are also used in typewriter printing can be selected and are usually comprised of Mylar coated with blends of soluble nylon, carbon black and mineral oil.

The optical density measurements recited herein, including the working examples, were obtained on a Pacific Spectrograph Color System. The system consists of two major components: an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component such as gloss was included. A high resolution full dispersion, grating monochromator was used to scan the spectrum from 380 to 720 nanometers. The data terminal features a 12 inch CRT display, numerical keyboard for selection of operating parameters, and the entry of tristimulus values; and an alphanumeric keyboard for entry of product standard information.

The following examples are being submitted to further define specific embodiments of the present invention, it being noted that these examples are intended to illustrate and not limit the scope of the present invention. Parts and percentages are by weight unless otherwise indicated.

EXAMPLE I

There were prepared 10 coated transparency sheets, each with a thickness of 100 microns, by affecting a dip coating (both sides coated) of these sheets (10) in a coating solution of nonionic methyl cellulose (Methocel A4M available from Dow Chemical Company), 35 percent by weight, anionic sodium carboxymethyl cellulose (CMC 7H3SX available from Hercules Chemical Company), 25 percent by weight, poly(ethylene oxide) (Poly OX WSRN-3000 available from Union Carbide), 20 percent by weight, and the noncellulosic component poly(acrylamide) (Scientific Polymer Products), 20 percent by weight, which blend was present in a concentration of 2 percent by weight in water. Subsequent to air drying for 60 minutes at 25° C. in a fumehood equipped with adjustable volume exhaust system and monitoring the difference in weight prior to and subsequent to coating, these dried sheets had deposited on each side 500 milligrams, 5 microns in thickness, of the aforementioned blend. These sheets were then individually fed into a Xerox Corporation 4020 TM color ink jet printer having incorporated therein four separate developer inks, commercially available from Sharp Inc., and believed to be comprised of water, 92 percent by weight, ethylene glycol, 5 percent by weight, and a magenta, cyan, yellow and black colorant, respectively, 3 percent by weight, and there were obtained images with an average optical density (that is the sum of the optical densities of 10 sheets divided by 10) values of 1.65 (black), 1.35 (magenta), 1.45 (cyan) and 0.85 (yellow). The 10 printed transparencies were placed in constant humidity (RH) and constant temperature environment preset at 80 percent RH and 80° F. temperature for humidity resistance testing, and all 10 of them did not evidence blooming or bleeding for a period of 7 days.

EXAMPLE II

There were prepared 50 coated transparency sheets, each with a thickness of 100 microns, by affecting a dip coating (both sides coated) of these sheets in a coating solution blend of nonionic hydroxyethyl cellulose (Natrosol 250LR available from Hercules Chemical Company), 25 percent by weight, anionic sodium carboxymethyl cellulose (CMC 7H3SX) 25 percent by weight, poly(ethylene oxide) (poly OX WSRN-3000), 25 percent by weight, and the noncellulosic component poly(acrylamide), 25 percent by weight, which blend was present in a concentration of 4 percent by weight in water. Subsequent to air drying for 60 minutes at 25° C. in a fumehood with adjustable volume exhaust system and monitoring the difference in weight prior to and subsequent to coating, these dried sheets had present on each side 800 milligrams, 8 microns in thickness, of the aforementioned coating blend. Ten of these sheets were then individually fed into a Xerox 4020 TM ink jet printer and there were obtained images with optical density values of 1.80 (black), 1.47 (magenta), 165 (cyan), and 0.89 (yellow). These images could not be hand wiped 60 seconds subsequent to their preparation.

EXAMPLE III

Ten (10) coated transparencies prepared by the process of Example II were fed into a Xerox 1005 TM color xerographic apparatus and images were obtained with average optical density values of 1.60 (black), 1.45 (magenta), 1.50 (cyan), and 0.90 (yellow). These images could not be hand wiped or lifted off with a 3M (Minnesota Mining and Manufacturing) scotch tape 60 seconds subsequent to their preparation.

EXAMPLE IV

Ten (10) coated transparencies prepared by the process of Example II were fed into a Xerox 1075 TM imaging apparatus and yielded images with an average optical density of 1.25 (black). These images could not be hand wiped or lifted off 60 seconds subsequent to their preparation.

EXAMPLE V

Ten (10) coated transparencies prepared by the process of Example II were fed through a dot Matrix printer, available from Roland Inc. as Roland PR-1012 TM. The average optical density of these images was 1.0 (black). These images could not be hand wiped or lifted off 200 seconds subsequent to their preparation.

EXAMPLE VI

Ten (10) coated transparencies prepared by the process of Example II were fed into the commercially available Hewlett Packard DeskJet TM Printer 2276-A having incorporated therein a dye based black ink believed to be comprised of 92 percent coater, 5 percent glycol, and food black #2 dye 3 percent by weight, and there were obtained images with an average optical density value of 2.3 (black). These images could not be hand wiped or lifted off 300 seconds subsequent to their preparation.

EXAMPLE VII

There were prepared ten coated transparency sheets, each with a thickness of 100 microns, by affecting a dip coating of these sheets in a coating blend solution of nonionic hydroxyethyl cellulose (Natrosol 250LR), 30 percent by weight, anionic sodium carboxymethyl cellulose (CMC 7H3SX), 35 percent by weight, poly(ethylene oxide) (Poly OX WSRN-3000), 25 percent by weight, and the noncellulosic component poly(ethylene imine) epichlorohydrin (available from Scientific Polymer Products), 10 percent by weight, which blend was present in a concentration of 3 percent by weight in water. Subsequent to air drying for 60 minutes at 25° and monitoring the weight prior to and subsequent to coating these dried sheets had present on both sides 600 milligrams, 6 microns in thickness, of the aforementioned coating blend. These sheets were then fed into a Xerox Corporation 4020 TM color ink jet printer and there were obtained images with average optical density values of 1.65 (black), 1.40 (magenta), 1.50 (cyan) and 0.95 (yellow). The aforementioned images could not be hand wiped 60 seconds subsequent to their preparation.

EXAMPLE VIII

There were prepared ten coated transparency sheets, each with a thickness of 100 microns, by affecting a dip coating of these sheets in a coating blend solution of nonionic ethylhydroxyethyl cellulose (Bermocoll available from Berol Kem Sweden), 30 percent by weight, anionic sodium carboxymethyl cellulose (CMC 7H3SX), 30 percent by weight, poly(ethylene oxide) (Poly OX WSRN-3000), 30 percent by weight and noncellulosic component vinyl pyrrolidone-diethylamino methylmethacrylate copolymer quaternized, 10 percent by weight, which blend was present in a concentration of 3 percent by weight in water. Subsequent to their air drying for 60 minutes these sheets had present on each side 700 milligrams, 7 microns in thickness, of the aforementioned blend. These sheets were then fed individually into a Xerox Corporation 4020 TM color ink jet printer and images were obtained with average optical density values of 1.62 (black), 1.39 (magenta), 1.51 (cyan) and 0.95 (yellow). The aforementioned images could not be hand wiped 120 seconds subsequent to their preparation.

EXAMPLE IX

There were prepared ten coated transparency sheets, each with a thickness of 100 microns, by affecting a dip coating of these sheets in a coating solution of nonionic hydroxypropylmethyl cellulose (Methocel K35LV available from Dow Chemical Company), 30 percent by weight, cationic hydroxyethyl cellulose (Polymer JR-125 available from Union Carbide), 20 percent by weight, poly(ethylene oxide) (Poly OX WSRN-3000), 35 percent by weight, poly(2-acrylamido-2-methyl propane sulfonic acid), 15 percent by weight, which blend was present in a concentration of 4 percent by weight in water. Subsequent to air drying for 60 seconds at 25° C. and monitoring the weight prior to and subsequent to coating, these dried sheets had present on both sides, 750 milligrams, 7.5 microns in thickness, of the aforementioned coating. These sheets were then individually fed into Xerox Corporation 4020 TM color ink jet printer and images were obtained with average optical density values of 1.73 (black), 1.40 (magenta), 1.52 (cyan) and 0.90 (yellow). The aforementioned images could not be hand wiped 180 seconds subsequent to their preparation.

EXAMPLE X

There were prepared ten coated transparency sheets, each with a thickness of 100 microns, by affecting a dip coating of these sheets in a coating blend solution of nonionic hydroxyethylcellulose (Natrosol 250LR), 25 percent by weight, nonionic hydroxpropylmethyl cellulose (Methocel K35LV), 20 percent by weight, anionic sodium carboxymethyl cellulose (CMC 7H3SX), 20 percent by weight, poly(ethylene oxide) (poly OX WSRN-3000), 20 percent by weight, and the noncellulosic component acrylamideacrylic acid copolymer (Scientific Polymer Products), 12 percent by weight, colloidal silica (Syloid 74 available from Grace Company), 3 percent by weight, which blend was present in a concentration of 4 percent by weight in a mixture of methanol (25 percent by weight) and water (75 percent by weight). Subsequent to air drying for 60 minutes at 25° C., these dried sheets had present on both sides 800 milligrams, 8.5 microns in thickness, of the aforementioned coating blend. These sheets were then individually fed into Xerox Corporation 4020 TM color ink jet printer and images were obtained with average optical density values of 1.80 (black), 1.45 (magenta), 1.50 (cyan) and 0.85 (yellow). These images could not be hand wiped 180 seconds subsequent to their preparation.

Other modifications of the present invention will occur to those skilled in the art, subsequent to a review of the present application. These modifications, including equivalents thereof, are intended to be included within the scope of the present invention.

What is claimed is:

1. A transparent substrate material for receiving or containing an image comprised of a supporting substrate and a coating thereon comprised of a mixture of the following components (a) one or more non-ionic cellulose; (b) one or more ionic celluloses; (c) poly(alkylene oxide), and (d) a noncellulosic component selected from the group consisting of (1) poly(imidazoline) quaternized; (2) poly(N,N-dialkyl-dialkylene piperidinium halide); (3) poly(acrylamido alkyl propane sulfonic acid); (4) poly(ethylene imine) epihalohydrin; (5) poly(acrylamide); (6) acrylamide-acrylic acid copolymer; (7) poly(vinyl pyrrolidone); (8) poly(vinyl alcohol); (9) vinyl pyrrolidone-dialkyl aminomethylmethacrylate copolymer quaternized, (10) vinyl pyrrolidone-vinyl acetate copolymer; and mixtures thereof.

2. A material in accordance with claim 1 wherein the nonionic celluloses are comprised of alkyl cellulose, hydroxyalkyl celluloses, alkyl hydroxy alkyl celluloses and hydroxy alkyl alkyl celluloses.

3. A material in accordance with claim 2 wherein the alkyl celluloses are comprised of methyl cellulose, ethyl cellulose, or ethyl methyl cellulose; the hydroxyalkyl celluloses are comprised of hydroxyethylcellulose, mono or dihydroxypropyl cellulose, or hydroxyethyl hydroxypropyl cellulose; the alkyl hydroxyalkyl celluloses are comprised of methylhydroxyethyl cellulose or ethylhydoxyethyl cellulose; and the hydroxyalkyl alkyl celluloses are comprised of hydroxymethylethyl cellulose, hydroxyethyl methyl cellulose, hydroxypropylmethyl cellulose or hydroxybutylmethyl cellulose.

4. A material in accordance with claim 1 wherein the ionic celluloses are comprised of anionic celluloses, cationic celluloses and amphoteric celluloses.

5. A material in accordance with claim 4 wherein the anionic celluloses are comprised of sodium carboxymethyl cellulose, sodium carboxymethyl methyl cellulose, sodium carboxymethylhydroxyethyl cellulose, or sodium cellulose sulfate; the cationic celluloses are comprised of quaternary hydroxypropyl trimethylammoniumchloridehydroxyethyl cellulose, or a quaternary diethyl ammoniumchloride cellulose; and the amphoteric celluloses are comprised of a carboxymethyl diaminoethyl cellulose.

6. A material in accordance with claim 1 wherein the poly(alkylene oxide) is comprised of poly(ethylene oxide), poly(propylene oxide), or poly(1,4-oxybutylene).

7. A material in accordance with claim 1 wherein the coating composition is comprised of about 1 to about 60 percent by weight of the nonionic celluloses, from about 55 to about 1 percent by weight of ionic celluloses, from about 43 to about 1 percent by weight of poly(alkylene oxide) and from about 1 to about 38 percent by weight of the noncellulosic component.

8. A material in accordance with claim 1 wherein the coating composition is comprised of from about 5 to about 55 percent by weight of the nonionic celluloses, from about 50 to about 5 percent by weight of the ionic celluloses, from about 40 to about 5 percent of poly(alkylene oxide), and from about 5 to about 35 percent by weight of the noncellulosic component.

9. A material in accordance with claim 1 wherein the coating composition contains a filler component.

10. A material in accordance with claim 9 wherein the filler component is colloidal silica, titanium dioxide or an alkali metal carbonate.

11. A material in accordance with claim 9 wherein the coating composition is comprised of from about 1 to about 50 percent by weight of the nonionic celluloses, from about 55 to about 1 percent by weight of the ionic celluloses, from about 42 to about 1 percent by weight of poly(alkylene oxide), from about 1 to about 23 percent by weight of the noncellulosic component, and from about 1 to about 25 percent by weight of the filler.

12. A material in accordance with claim 9 wherein the coating is comprised of from about 5 to about 50 percent by weight of the nonionic celluloses, from about 50 to about 5 percent by weight of the ionic celluloses, from about 40 to about 5 percent by weight of poly(alkylene oxide), from about 4 to about 35 percent by weight of the noncellulosic component, and from about 1 to about 5 percent by weight of the filler.

13. A material in accordance with claim 1 wherein the coating composition is comprised of from about 5 to about 55 percent by weight of methyl cellulose, from about 50 to about 5 percent by weight of cationic hydroxyethyl cellulose, from about 40 to about 5 percent by weight of poly(ethylene oxide), and from about 5 to about 35 percent by weight of poly(imidazoline) quaternized.

14. A material in accordance with claim 1 wherein the coating composition is comprised of from about 5 to 55 percent by weight of methyl cellulose, from about 50 to about 5 percent by weight of sodium carboxymethyl cellulose, from about 40 to about 5 percent by weight of poly(ethylene oxide), and from about 5 to about 35 percent by weight of poly(acrylamide).

15. A material in accordance with claim 1 wherein the coating composition is comprised of from about 5 to about 55 percent by weight of methyl cellulose, from about 50 to about 5 percent by weight of carboxymethyl diaminoethyl cellulose, from about 40 to about 5 percent by weight of poly(ethylene oxide), and from about 5 to about 35 percent by weight of poly(N,N-dimethyl-3,5-dimethylene piperidinium chloride).

16. A material in accordance with claim 1 wherein the coating composition is comprised of from about 5 to about 55 percent by weight of methyl cellulose, from about 50 to about 5 percent by weight of sodium carboxymethyl cellulose, from about 40 to about 5 percent by weight of poly(ethylene oxide), and from about 5 to about 35 percent by weight of a vinyl pyrrolidone-diethylaminomethylmethacrylate copolymer quaternized.

17. A material in accordance with claim 1 wherein the coating composition is comprised of from about 5 to about 55 percent by weight of hydroxyethyl cellulose, from about 50 to about 5 percent by weight of sodium carboxymethyl cellulose, from about 40 to about 5 percent by weight of poly(ethylene oxide), and from 5 to about 35 percent by weight of a vinyl pyrrolidone-diethylaminomethylmethacrylate copolymer quaternized.

18. A material in accordance with claim 1 wherein the coating composition is comprised of from about 5 to about 55 percent by weight of hydroxyethyl cellulose, from about 50 to about 5 percent by weight of sodium cellulose sulfate, from about 40 to about 5 percent by weight of poly(ethylene oxide), and from about 5 to about 35 percent by weight of a poly(ethylene imine)epichlorohydrin.

19. A material in accordance with claim 1 wherein the coating composition is comprised of from about 5 to about 55 percent by weight of hydroxyethyl cellulose, from about 50 to about 5 percent by weight of quaternary diethyl ammoniumchloride cellulose, from about 40 to about 5 percent by weight of poly(ethylene oxide), and from about 5 to about 35 percent by weight of poly(vinyl pyrrolidone).

20. A material in accordance with claim 1 wherein the coating composition is comprised of from about 5 to about 55 percent by weight of hydroxyethyl cellulose, from about 50 to about 5 percent by weight of carboxymethyl diaminoethyl cellulose, from about 40 to about 5 percent by weight of poly(ethylene oxide), and from about 5 to about 35 percent by weight of poly(N,N-dimethyl-3,5-dimethylene piperidinium chloride).

21. A material in accordance with claim 1 wherein the coating composition is comprised of from about 5 to about 55 percent by weight of hydroxyethyl cellulose, from about 50 to about 5 percent by weight of sodium carboxymethyl cellulose, from about 40 to about 5 percent by weight of poly(ethylene oxide), and from about 5 to about 35 percent by weight of a poly(acrylamide).

22. A material in accordance with claim 1 wherein the coating composition is comprised of from about 5 to about 55 percent by weight of ethylhydroxyethyl cellulose, from about 50 to about 5 percent by weight of sodium carboxymethylethyl cellulose, from about 40 to about 5 percent by weight of poly(ethylene oxide), and from about 5 to about 35 percent by weight of poly(vinyl alcohol).

23. A material in accordance with claim 1 wherein the coating composition is comprised of from about 5 to about 55 percent by weight of ethylhydroxyethyl cellulose, from about 50 to about 5 percent by weight of sodium carboxymethyl cellulose, from about 40 to about 5 percent by weight of poly(ethylene oxide), and from about 5 to about 35 percent by weight of a vinyl pyrrolidone-vinyl acetate copolymer.

24. A material in accordance with claim 1 wherein the coating composition is comprised of from about 5 to about 55 percent by weight of ethylhydroxyethyl cellulose, from about 50 to about 5 percent by weight of cationic hydroxyethyl cellulose, from about 40 to about 5 percent by weight of poly(ethylene oxide), and from about 5 to about 35 percent by weight of a poly(imidazoline) quaternized.

25. A material in accordance with claim 1 wherein the coating composition is comprised of from about 5 to about 55 percent by weight of ethylhydroxyethyl cellulose, from about 50 to about 5 percent by weight of quaternary diethyl aminoethyl cellulose, from about 40 to about 5 percent by weight of poly(ethylene oxide), and from about 5 to about 35 percent by weight of a poly(2-acrylamido-2-methyl propane sulfonic acid).

26. A material in accordance with claim 1 wherein the coating composition is comprised of from about 5 to about 55 percent by weight of hydroxypropyl methyl cellulose, from about 50 to about 5 percent by weight of cationic hydroxyethyl cellulose, from about 40 to about 5 percent by weight of poly(ethylene oxide), and from about 5 to about 35 percent by weight of a poly(2-acrylamido-2-methyl propane sulfonic acid).

27. A material in accordance with claim 1 wherein the coating composition is comprised of from about 5 to about 55 percent by weight of hydroxybutyl cellulose, from about 50 to about 5 percent by weight of carboxymethyl diaminoethyl cellulose, from about 40 to about 5 percent by weight of poly(ethylene oxide), and from about 5 to about 35 percent by weight of poly(vinyl alcohol).

28. A material in accordance with claim 1 wherein the coating composition is comprised of from about 5 to about 55 percent by weight of hydroxypropyl methyl cellulose, from about 50 to about 5 percent by weight of sodium carboxymethyl cellulose, from about 40 to about 5 percent by weight of poly(ethylene oxide), and from about 5 to about 35 percent by weight of a poly(acrylamide).

29. A material in accordance with claim 1 wherein the supporting substrate is coated on both sides thereof.

30. A material in accordance with claim 1 wherein the coating is present in a thickness of from about 5 to about 25 microns.

31. A material in accordance with claim 1 wherein the supporting substrate is coated from said polymer mixture dissolved in a mixture of water with an aliphatic alcohol.

32. A material in accordance with claim 1 wherein the supporting substrate is selected from the group consisting of cellulose acetate, poly(sulfone), poly(propylene), poly(styrene), poly(vinyl chloride), poly(vinyl fluoride), cellophane and poly(ethylene terephthalate).

33. A material in accordance with claim 1 wherein the substrate is a thickness of about 50 to about 150 microns.

34. A material in accordance with claim 1 wherein alkyl contains from 1 to about 25 carbon atoms.

35. A material in accordance with claim 1 wherein alkyl contains from 1 to about 6 carbon atoms.

36. An image receiving member for an electrographic or electrophotographic imaging process, which member is comprised of a supporting substrate and a coating thereon comprised of a mixture of the following components (a) one or more nonionic celluloses; (b) one or more ionic celluloses; (c) poly(alkylene oxide), and (d) a noncellulosic component selected from the group consisting of (1) poly(imidazoline) quarternized; (2) poly(N,N-dialkyl-dialkylene piperidinium halide); (3) poly(acrylamido alkyl propane sulfonic acid); (4) poly(ethylene imine) epihalohydrin; (5) poly(acrylamide); (6) acrylamide-acrylic acid copolymer; (7) poly(vinyl pyrrolidone); (8) poly(vinyl alcohol); (9) vinyl pyrrolidone-dialkyl aminomethylmethacrylate copolymer quaternized; (10) vinyl pyrrolidone-vinyl acetate copolymer; and mixtures thereof.

37. A transparency comprised of a supporting substrate and on both sides thereof a coating thereon comprised of a mixture of the following components (a) one or more nonionic celluloses, (b) one or more ionic celluloses, (c) poly(alkylene oxide) and (d) a noncellulosic component selected from the group consisting of (1) poly(imidazoline) quaternized; (2) poly(N,N-dimethyl-3,5, dimethylene piperidinium chloride); (3) poly(2-acrylamido-2-methyl propane sulfonic acid); (4) poly(ethylene imine) epichlorohydrin; (5) poly(acrylamide); (6) acrylamide-acrylic acid copolymer; (7) poly(vinyl pyrrolidone); (8) poly(vinyl alcohol); (9) vinyl pyrrolidone-diethylamino methylmethacrylate copolymer quaternized; (10) and a vinyl pyrrolidone-vinyl acetate copolymer.

38. A transparency in accordance with claim 37 wherein the coating contains a filler component.

39. A transparency in accordance with claim 38 wherein the filler is colloidal silica.

40. A transparency in accordance with claim 37 wherein the nonionic celluloses are comprised of alkyl celluloses, hydroxyalkyl celluloses, alkyl hydroxy alkyl celluloses or hydroxy alkyl alkyl celluloses.

41. A transparency in accordance with claim 40 wherein the alkyl celluloses are comprised of methyl cellulose, ethyl cellulose, or ethyl methyl cellulose; the hydroxyalkyl celluloses are comprised of hydroxyethylcellulose, mono or dihydroxypropyl cellulose, or hydroxyethyl hydroxypropyl cellulose; the alkyl hydroxyalkyl celluloses are comprised of methylhydroxyethyl cellulose or ethylhydroxyethyl cellulose; the hydroxyalkyl alkyl celluloses are comprised of hydroxymethylethyl cellulose, hydroxyethyl methyl cellulose, hydroxypropylmethyl cellulose or hydroxybutylmethyl cellulose.

* * * * *